United States Patent [19]

Mueller

[11] 4,379,474

[45] Apr. 12, 1983

[54] HEDDLE FRAME ACTUATING MECHANISM LOCATED BETWEEN A DOBBY AND THE HEDDLE FRAMES OF A WEAVING MACHINE

[75] Inventor: Otto Mueller, Uetikon am See, Switzerland

[73] Assignee: Staeubli Ltd., Horgen-Zuerich, Switzerland

[21] Appl. No.: 197,726

[22] Filed: Oct. 16, 1980

[30] Foreign Application Priority Data

Oct. 19, 1979 [CH] Switzerland ..... 9401/79

[51] Int. Cl.[3] ..... D03D 39/16

[52] U.S. Cl. ..... 139/21; 139/55.1; 139/82

[58] Field of Search ..... 139/20, 21, 55.1, 57, 139/59, 76, 78, 82, 171

[56] References Cited

U.S. PATENT DOCUMENTS

| | | | |
|---|---|---|---|
| 3,128,796 | 4/1964 | Bergstrom et al. | 139/171 |
| 3,168,116 | 2/1965 | Krenz | 139/57 |
| 3,759,298 | 9/1973 | Kaufmann | 139/82 |
| 4,201,248 | 5/1980 | Delaplace et al. | 139/21 |
| 4,314,588 | 2/1982 | Speich | 139/82 |

FOREIGN PATENT DOCUMENTS

| | | | |
|---|---|---|---|
| 489050 | 1/1930 | Fed. Rep. of Germany | 139/55.1 |
| 2722433 | 11/1978 | Fed. Rep. of Germany | 139/55.1 |

*Primary Examiner*—Henry Jaudon

*Attorney, Agent, or Firm*—Flynn, Thiel, Boutell & Tanis

[57] ABSTRACT

In an attempt to form a compact arrangement of a control unit for a weaving machine, according to U.S. Pat. No. 3,759,298, undesired distortions result in the sequence of movement of the heddle frame due to the installation of a short connecting rod. To prevent this, the heddle frame actuating mechanism has one double arm lever pivotally supported on an arm of a further double arm lever, a connecting rod hingedly connected at its one end to a still further double arm lever. The arm of the further double arm lever and the arm of the one double arm lever are in alignment rectilinearly in the center-shed position and are together equal in length to the length of a first arm of the still further double arm lever, so that these two arms, the connecting rod and a connecting line extending between the fixedly arranged pivot axles for the further double arm lever and the still further double arm lever form a parallelogram.

5 Claims, 7 Drawing Figures

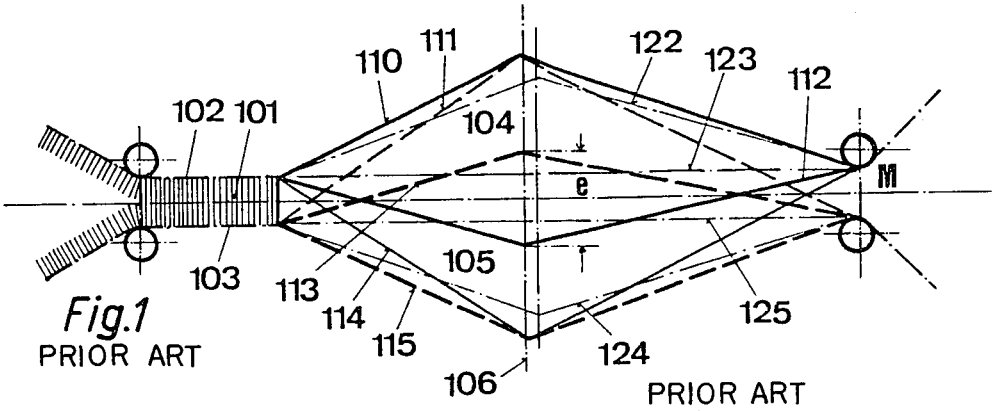
Fig.1
PRIOR ART
PRIOR ART
Fig.2
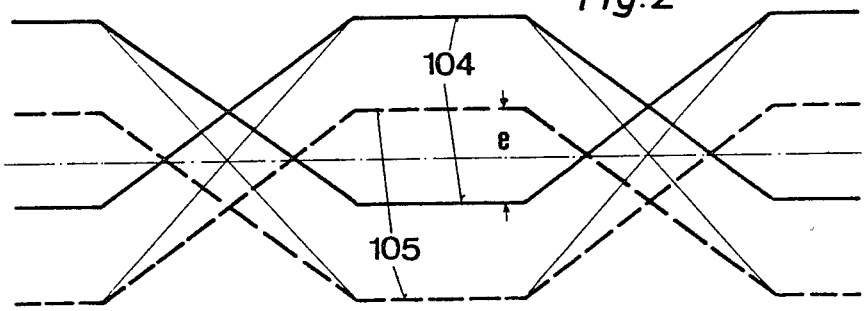
Fig.3
PRIOR ART
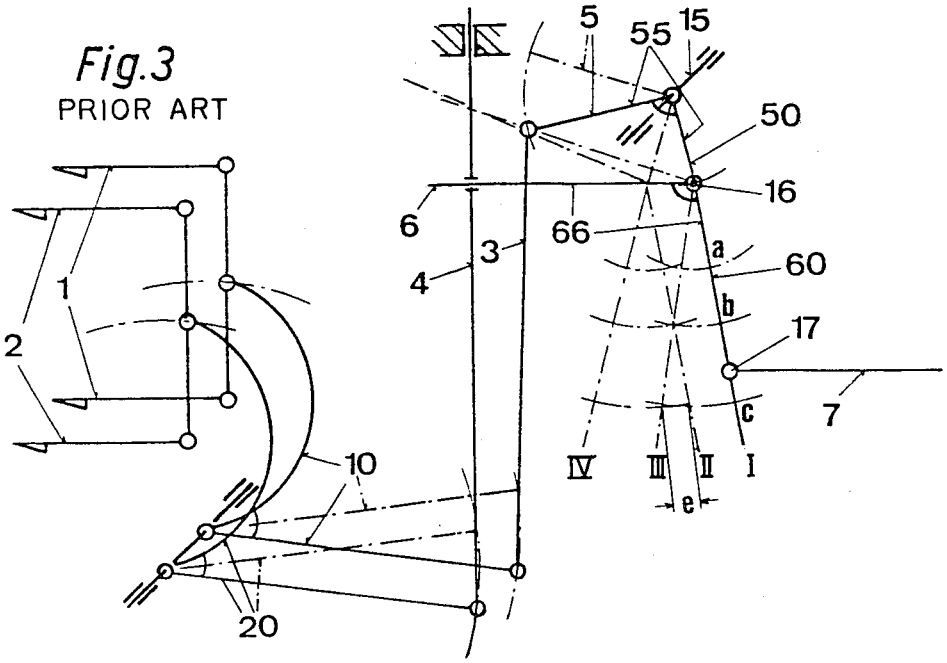

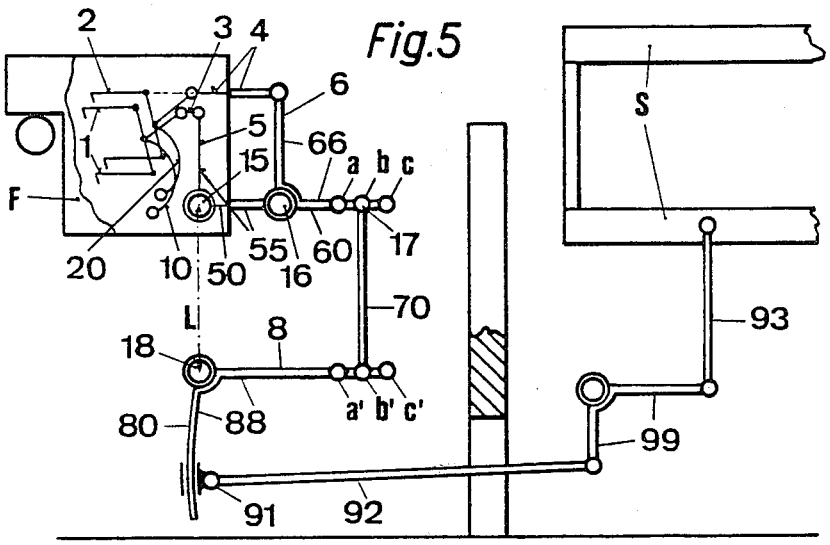
PRIOR ART
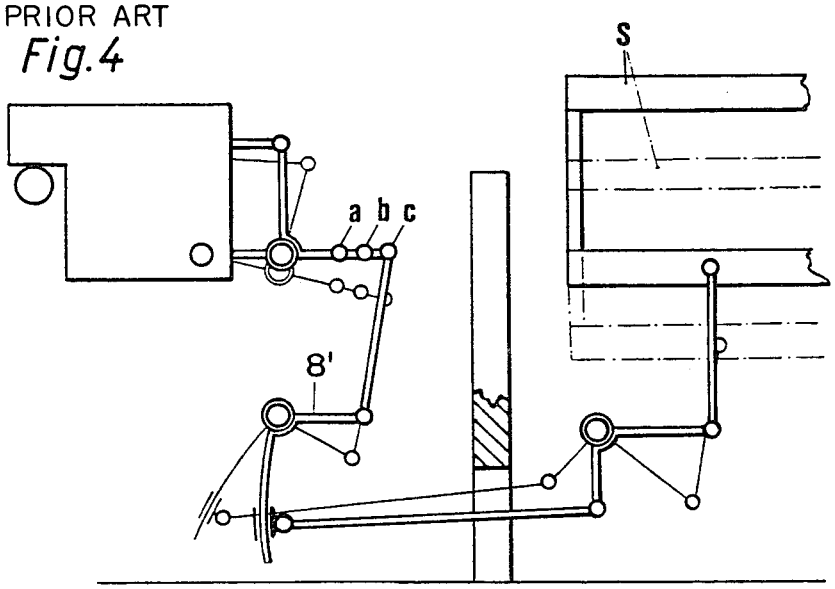

HEDDLE FRAME ACTUATING MECHANISM LOCATED BETWEEN A DOBBY AND THE HEDDLE FRAMES OF A WEAVING MACHINE

FIELD OF THE INVENTION

The invention relates to a heddle frame actuating mechanism located between a shed-forming machine for the selective control of a heddle frame of a weaving machine in at least three shed positions with structure facilitating an adjustment of the heddle frame stroke without necessitating a movement of the heddle frames during the adjustment procedure.

BACKGROUND OF THE INVENTION

To manufacture pile fabrics, like velvet and plush fabrics, weaving machines are primarily used, which simultaneously weave two fabric strands one above the other, between which are arranged the pile threads which are to be separated at the end of the weaving process. In order for the pile to have the desired quality, a fine control over the heddle frame, particularly at the end positions of the pile heddle frames, must be performed. The heddle frames move thereby between three shed positions, namely, a lower shed position, a middle shed position and an upper shed position. The center shed, and the type and manner with which the heddle frame moves through it, is of a very special importance. The middle-shed positions of various heddle frames overlap or undercut one another in special cases.

U.S. Pat. No. 3,759,298 describes in greater detail the theoretical and practical mode of operation of a machine for the manufacture of such a fabric. Various types of drives for the pile heddle frames are discussed. These can be identified as addition gearings, since two elements which are each driven by a baulk are coupled with one another in such a manner that they reciprocally influence their attained positions. The movements which are achieved with the drives are transmitted through long rods in the heddle frame actuating mechanism onto the heddle frames. In a more compact construction of the weaving machine having a dobby, the long rod of the heddle frame actuating mechanism becomes considerably shorter, from which result distortions in movement. Furthermore, undesired changes in the two end positions of the pile heddle frame were found, when the position of the heddle frame is controlled in the area of the center-shed position.

The purpose of the invention is to eliminate the unfavorable influence of a particularly short connecting rod and to simplify the adjusting operations for the three basic positions.

This is achieved in the mentioned heddle frame actuating mechanism by arranging in the heddle frame actuating mechanism between one arm on each of two pivotal double arm levers a relatively short connecting rod so that in the center position of the heddle frame, the arms form with the connecting rod and a connecting straight line extending between two basic pivot axles of the arms a parallelogram. This is practically achieved in the linkage connection by inventively providing the heddle frame actuating mechanism with a relatively short connecting rod, one end of which is hingedly movable and securable on the second arm of the second double arm lever, and the second end of the connecting rod is hingedly connected to the first arm of a third double arm lever of the heddle frame actuating mechanism, which is supported on a fixed axle. In the shed-center position of the heddle frame, the second arm of the first double arm lever extends in alignment, namely a rectilinear extension of the second arm of the second double arm lever and the two arms together are equal in length up to the hinge point of the connecting rod in the phase of the center position, as the length of the first arm of the third double arm lever, and form a parallelogram with the connecting rod and a connecting line extending through the pivot axles supporting the first double arm lever and the third double arm lever which makes it possible in this position to move the connecting rod parallel and to hinge same again on the adjacent arms without changing the heddle frame position.

BRIEF DESCRIPTION OF THE DRAWINGS

One exemplary embodiment of the subject matter of the invention will be discussed in greater detail with reference to the drawings, wherein the description and drawings of U.S. Pat. No. 3,759,298 is to be an integral part of this discussion.

FIG. 1 illustrates corresponding with FIG. 5 of the above-mentioned patent the positions of the warp threads, which are used to weave pile fabric, wherein the lower-shed position of the pile heddle frames for the upper basic fabric lies lower than the upper-shed position of the pile heddle frames for the lower base fabric, that is, the pile heddle frames assume four different positions;

FIG. 2 illustrates the associated time-path-diagram of the principle of the heddle frame movement;

FIG. 3 illustrates in a perspective view an embodiment of a heddle frame drive for a pile heddle frame, which embodiment corresponds to the illustration in FIG. 12 of the above-mentioned patent;

FIG. 4 schematically illustrates two positions of a conventional heddle frame actuating mechanism extending between a dobby and a heddle frame;

FIG. 5 schematically illustrates a center-shed position of an inventive heddle frame actuating mechanism extending between a dobby and a heddle frame;

DETAILED DISCUSSION

Figure 6:
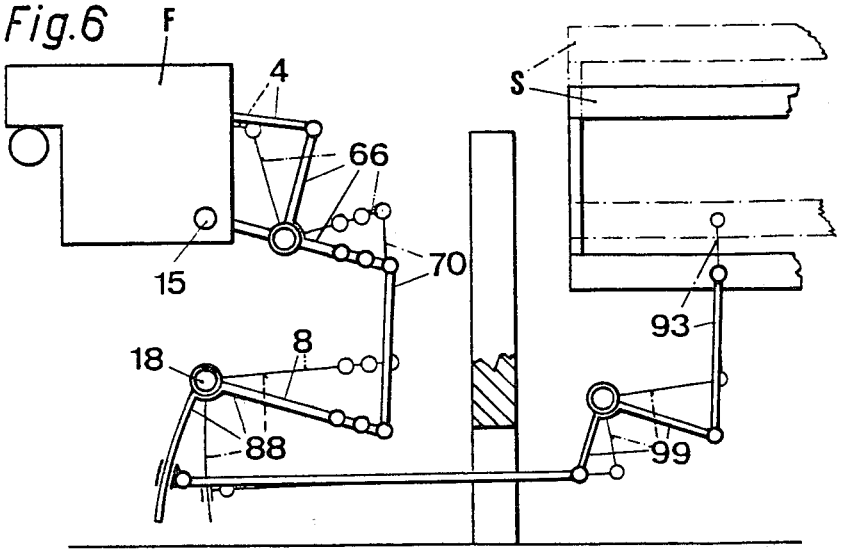
FIG. 6 illustrates the same heddle frame actuating mechanism in two controlled positions.

FIGS. 1 and 2 identify the warp threads 122 or 123 for the upper shed 104 or the upper base fabric 102 and reference numerals 124 or 125 identify the warp threads for the lower shed 105 or the lower base fabric 103, and the possible positions of the pile thread are identified by the reference numerals 110, 111, 112, 113, 114, and 115. The pile threads on the upper and lower base fabrics result during a weaving in of the specific pile threads 101 between the two base or foundation fabrics 102, 103. In the illustrated example, the eyelet on the pile heddle frame which is arranged in the plane 106 exceeds for the pile thread the center plane M. The distance e which is achieved with this movement corresponds to technical weaving requirements and influences the type of pile fabric achieved. Thereafter, the pile threads are separated by cutting approximately at half of their length and two fabric webs with pile trimmings on one side of each thereof are created.

FIG. 3 illustrates the drive mechanism for the pile heddle frame, starting out from a dobby, of the Hattersley system, with two lifting units 1 and 2 consisting of baulk and connected draw hook. Each two-arm rocking lever 10, 20 engages the baulks.

The rocking lever 10 is operatively connected through the rod 3 to the first arm 5 of a first double arm lever 55, which is supported on the fixed axis 15. The double arm lever 55 has a first arm 5 and a second arm 50. A second double arm lever 66 is rotatably supported at the joint 16 on the second arm 50 of the first double lever 55. The first arm 6 of the double lever 66 is operatively connected to and through the rod 4 to the rocking lever 20. The second arm 60 of the second double lever 66 serves as a coupling part for the heddle frame actuating mechanism 7.

Due to the support of the second double arm lever 66 on the first arm 50 of the first double arm lever 55, the entire system acts as an additional gearing. The movements are additive so that in two base positions of the lifting units 1 and 2, four positions I, II, III and IV for the second arm 60 of the double arm lever 66 are obtained, on which arm 60 is hingedly supported at 17 the draw rod 7 which in turn is connected to the heddle frame. The hinge joint 17 of the draw rod 7 can be adjusted steplessly and fixed at selected positions a, b or c. The distance e in FIG. 3 corresponds with the distance e representing the total amount of reciprocal overlap of the pile heddle frames in FIGS. 1 and 2.

The inventive heddle frame actuating mechanism is connected through the conventional addition gearing, in the form of a lever connection according to FIG. 5, to the heddle frame. FIG. 5 schematically illustrates a shed-forming machine F having two lifting units 1 and 2, rocking levers 10 and 20 and rods 3 and 4. The first double arm lever 55 with its first arm 5 is hingedly connected to the rod 3. This double arm lever is pivotally supported on the fixed axle 15. The second arm 50 functions as a bearing for the pivot axle 16 of the second double arm lever 66, the first arm 6 of which is connected to the rod 4, and the second arm 60 of which has three hinge points a, b and c thereon for facilitating a connection to the short connecting rod 70.

The three hinge points a', b' and c' for the other end of the connecting rod 70 are provided on the first arm 8 of a third double arm lever 88, which is pivotally supported on a fixed shaft 18 mounted, for example, on a not-illustrated frame used to support the dobby or shed-forming machine F. The hinge points a, b, c or a', b', c' have the same spacing from one another. A rail 92 is hingedly connected through a joint 91 on an arcuate second arm 80 and transmits through a further swingable double arm lever 99 and linkage member 93 a movement onto the heddle frame S. A regulating of the magnitude of the heddle frame movement occurs advantageously by moving the joint 91 on the arcuate arm 80, whereby the centerpoint of the arc for the arcuate arm 80 lies on the rail 92 at the junction thereof with the end of the suspended part of the double arm lever 99, when all levers assume the center-shed position.

FIG. 4 illustrates the center-shed position M of the heddle frame S in thick full lines, namely both lifting units 1 and 2 are half extended. When the inventive requirements are not considered, namely the up-to-now common lever arrangement, an adjusting of the short connecting rod 70 into the positions a, b, c, for the purpose of altering the dimension e, in the sense of an enlargement or reduction in the magnitude of the overlap (see FIG. 3), results simultaneously in an undesired change of the two outer base positions of the pile heddle frame. Note that the FIG. 4 embodiment does not have the hinge points a', b', c' on the arm 8'.

If the arm 8 would also have three hinge points as shown in FIG. 5, then it would be possible to move the short connecting rod 70 parallel by connecting to points a—a', b—b' and c—c'. The lifting movement of the lifting units 1, 2 would result in distorted upper and lower-shed positions with respect to the center position for the heddle frame, which is undesired for the weaving process (thin-line position in FIG. 4).

In the case of the inventive arrangement according to FIG. 5, we deal with a theoretical position, namely the center position M as shown in the FIG. 1, which is selected for attaching the heddle frames, however, is not used during the weaving process. The fixed axle of rotation 15 of the first double arm lever 55 is positioned vertically above the fixed shaft 18 supporting the third double arm lever 88. The second arm 60 of the second double arm lever 66 is a rectilinear extension of the second arm 50 of the first double arm lever 55. The entire length of the second arm 50 of the first double arm lever 55 and the length of the second arm 60 of the second double arm lever 66 to the hinge points a, b, c corresponds to the length of the first arm 8 of the third double arm lever 88. The connecting rod 70 is positioned almost perpendicularly to the arms 60 and 8 in the position shown in FIG. 5. The arms 50 and 60 form with the connecting rod 70 and the arm 8 and the connecting line L extending between the axles 15 and 18 a parallelogram, which upon pivoting about the axles 15, 18 results in a small disregardable distortion, since the side L will remain stationary.

Since the lever arms 50, 60 and 8 and the line L form a parallelogram, it will be recognized that the distance between the ends of the connecting rod 70 is substantially equal to the distance between the axles 15 and 18.

Changing of the rod 70 into other joint pairs a—a', b—b' or c—c' is made easier with the perpendicular position of the connecting rod 70 to the arms 60, 8. A change in the height of the heddle frame or a change of the total heddle frame stroke will not occur when the connecting rod is so moved. Only the amount of overlap of the heddle frame center position in the region e is changed. The time - path - requirements for the heddle frame movement remain unchanged.

Figure 7:
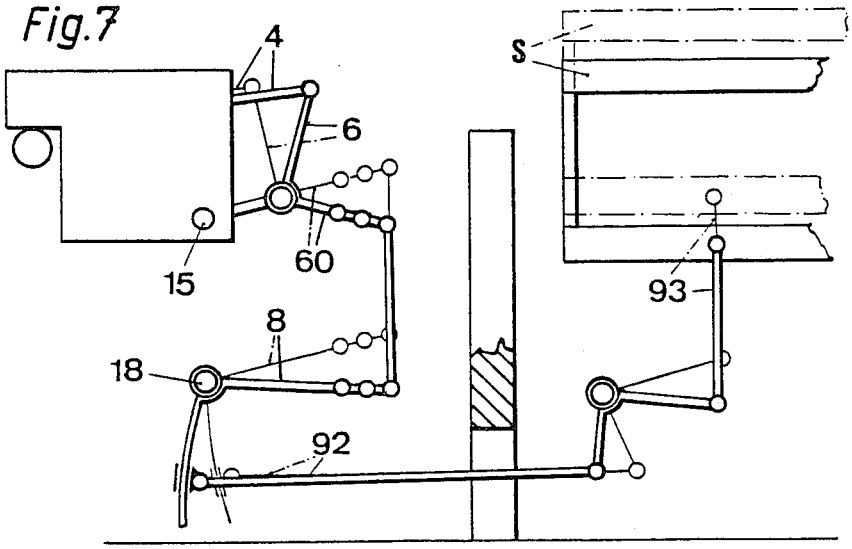
FIG. 7 illustrates again the same heddle frame actuating mechanism in two further controlled positions, whereby FIGS. 4 to 7 each do not show the second or third heddle frame driving lever for the other end of the heddle frame.

FIGS. 6 and 7 illustrate the different positions of the rod 70 during operation. The connecting rod 70 is hingedly connected to the levers 8 and 60 in the points c, thus extreme paths of movement corresponding with FIG. 3.

FIG. 6 illustrates, with thick lines, a position corresponding with the path of movement in point Ic of FIG. 3. Both lifting units 1 and 2 are in the base position, the heddle frame is in its lower most position. The thin-line position corresponds with point IIIc, namely the lifting unit 2 was operated (pivoting of the second double arm lever 66) and the heddle frame is above the center position.

FIG. 7 illustrates, with thick lines, a position corresponding with the path of movement in point IIc of FIG. 3 (operating the lifting unit 1) and the heddle frame is below the center position M. The thin-line position corresponds with point IVc, namely the lifting unit 2 was operated in addition to the lifting unit 1 (pivoting of the first double arm lever 55, and the second double arm lever 66), the heddle frame is in its highest position.

Although a preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A heddle frame actuating mechanism for operatively coupling a weaving machine having a movably supported heddle frame and a shed-forming machine having two lifting units, comprising a first lever supported for pivotal movement about a stationary first axis, means for drivingly coupling one of said lifting units to said first lever, a second lever supported on said first lever for pivotal movement about a second axis spaced from and substantially parallel to said first axis, means for drivingly coupling the other of said lifting units to said second lever, a third lever supported for pivotal movement about a stationary third axis spaced from and substantially parallel to said first and second axes, means for drivingly coupling said third lever to said heddle frame, a connecting member having first and second ends, the distance between said first and second ends being substantially equal to the distance between said first and third axes, means for pivotally supporting said first and second ends of said connecting member on said second lever and said third lever, respectively, at selected locations thereon so that said first and second ends of said connecting member are respectively spaced from said second and third axes and so that, when said second lever is in a predetermined position relative to said first lever, the distance between said first axis and said first end of said connecting member is substantially equal to the distance between said third axis and said second end of said connecting member.

2. A heddle frame actuating mechanism for operatively coupling a weaving machine having a pile heddle frame and a shed-forming machine having two lifting units which selectively control movement of said pile heddle frame between a plurality of different shed positions, comprising a first double arm lever pivotally supported on a first stationary bearing axle, said first lever having first and second arms and said first arm thereof being operatively coupled to a first said lifting unit, a second double arm lever pivotally supported on said second arm of said first lever at a location spaced from said first axle and having first and second arms, said first arm of said second lever being operatively coupled to a second said lifting unit, an elongate connecting rod, one end of said connecting rod being pivotally supported on said second arm of said second lever, and a third double arm lever pivotally supported on a second stationary axle and having first and second arms, the other end of said connecting rod being pivotally supported on said first arm of said third lever of said heddle frame actuating mechanism and said second arm of said third lever being operatively connected to said pile heddle frame, wherein in one position of said heddle frame said second arm of said first lever extends in rectilinear alignment with said second arm of said second lever and the distance between said first axle and the location at which said one end of said connecting rod is supported on said second arm of said second lever is substantially equal to the distance between said second axle and the location at which said other end of said connecting rod is pivotally supported on said first arm of said third lever, said second arms of said first and second levers and said first arm of said third lever forming substantially a parallelogram with said connecting rod and a connecting line which extends between said first and second axles, and wherein said pivotal support of said ends of said connecting rod on said first and second arms of said second and third levers can be effected at plural locations therealong, whereby it is possible in said position of said heddle frame to move said connecting rod to a position substantially parallel to its original position and to pivotally support it again on said second arm of said second lever and said first arm of said third lever without moving said pile heddle frame from said one position.

3. The heddle frame actuating mechanism according to claim 2, wherein said parallelogram is almost a rectangle.

4. The heddle frame actuating mechanism according to claim 2, wherein said support of said ends of said connecting rod on said second arm of said second lever and said first arm of said third lever at plural locations therealong can be effected steplessly.

5. The heddle frame actuating mechanism according to claim 2, wherein three said locations are provided for each of said one and said other ends of said connecting rod at equal distances along said second arm of said second lever and said first arm of said third lever, respectively.

* * * * *